US011052656B2

(12) United States Patent
Anderson et al.

(10) Patent No.: US 11,052,656 B2
(45) Date of Patent: Jul. 6, 2021

(54) FLUID ACTUATOR EVALUATION INDEPENDENT OF ACTUATION STATE

(71) Applicant: HEWLETT-PACKARD DEVELOPMENT COMPANY, L.P., Spring, TX (US)

(72) Inventors: Daryl E Anderson, Corvallis, OR (US); Eric Martin, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/613,190

(22) PCT Filed: Jul. 11, 2017

(86) PCT No.: PCT/US2017/041533
§ 371 (c)(1),
(2) Date: Nov. 13, 2019

(87) PCT Pub. No.: WO2019/013768
PCT Pub. Date: Jan. 17, 2019

(65) Prior Publication Data

US 2020/0180305 A1 Jun. 11, 2020

(51) Int. Cl.
*B41J 2/045* (2006.01)
*B41J 2/14* (2006.01)

(52) U.S. Cl.
CPC ..... *B41J 2/0458* (2013.01); *B41J 2/04541* (2013.01); *B41J 2/04543* (2013.01);
(Continued)

(58) Field of Classification Search
CPC .. B41J 2/0458; B41J 2/04541; B41J 2/04543; B41J 2/04573; B41J 2/14153
See application file for complete search history.

(56) References Cited

U.S. PATENT DOCUMENTS 5,121,688 A 6/1992 Williams et al.
6,183,055 B1 * 2/2001 Kanematsu ..... G06K 15/107 347/15

(Continued)

FOREIGN PATENT DOCUMENTS

| | | |
|---|---|---|
| EP | 0851385 | 2/2005 |
| EP | 2915671 | 9/2015 |
| WO | WO-2016004125 | 1/2016 |

OTHER PUBLICATIONS

Webpage. Diagnostic Nozzle Print. Retrieved Jun. 28, 2017. <https://dgs.oce.com/PrinterSupport/T220_Customer/WebHelp/-M028523.htm >.

*Primary Examiner* — Jason S Uhlenhake
(74) *Attorney, Agent, or Firm* — Fabian VanCott

(57) ABSTRACT

In one example in accordance with the present disclosure, a fluidic die is described. The fluidic die includes an array of fluid actuators grouped into primitives. The fluidic die also includes a fluid actuator controller to selectively activate fluid actuators via activation data. The fluidic die also includes an array of actuator evaluators, wherein each actuator evaluator of the fluidic die is coupled to a subset of the array of fluid actuators. The actuator evaluators selectively evaluate an actuator characteristic of a selected fluid actuator based on: an output of an actuator sensor paired with the selected fluid actuator, the activation data, and an evaluation control signal.

20 Claims, 5 Drawing Sheets

(52) U.S. Cl.
CPC ..... *B41J 2/04573* (2013.01); *B41J 2/14153* (2013.01); *B41J 2002/14354* (2013.01); *B41J 2002/14467* (2013.01); *B41J 2202/12* (2013.01)

(56) References Cited

U.S. PATENT DOCUMENTS

| | | | | |
|---|---|---|---|---|
| 8,460,947 | B2 | 6/2013 | Leigh et al. | |
| 2008/0084436 | A1 | 4/2008 | Sheahan | |
| 2013/0176355 | A1 | 7/2013 | Kritchman et al. | |
| 2017/0043577 | A1 | 2/2017 | Cumbie et al. | |
| 2017/0092653 | A1 | 3/2017 | Ho et al. | |
| 2018/0043687 | A1* | 2/2018 | Govyadinov ..... | G01N 15/14 |

* cited by examiner

FLUID ACTUATOR EVALUATION INDEPENDENT OF ACTUATION STATE

BACKGROUND

A fluidic die is a component of a fluid ejection system that includes a number of fluid ejecting nozzles. The fluidic die can also include other non-ejecting actuators such as micro-recirculation pumps. Through these nozzles and pumps, fluid, such as ink and fusing agent among other fluids, is ejected or moved. Over time, these nozzles and pumps can become clogged or otherwise inoperable. As a specific example, ink in a printing device can, over time, harden and crust. This can block the nozzle and interrupt the operation of subsequent ejection events. Other examples of issues affecting these actuators include fluid fusing on an ejecting element, particle contamination, surface puddling, and surface damage to die structures. These and other scenarios may adversely affect operations of the device in which the fluidic die is installed.

BRIEF DESCRIPTION OF THE DRAWINGS

The accompanying drawings illustrate various examples of the principles described herein and are part of the specification. The illustrated examples are given merely for illustration, and do net limit the scope of the claims.

Figure 1:
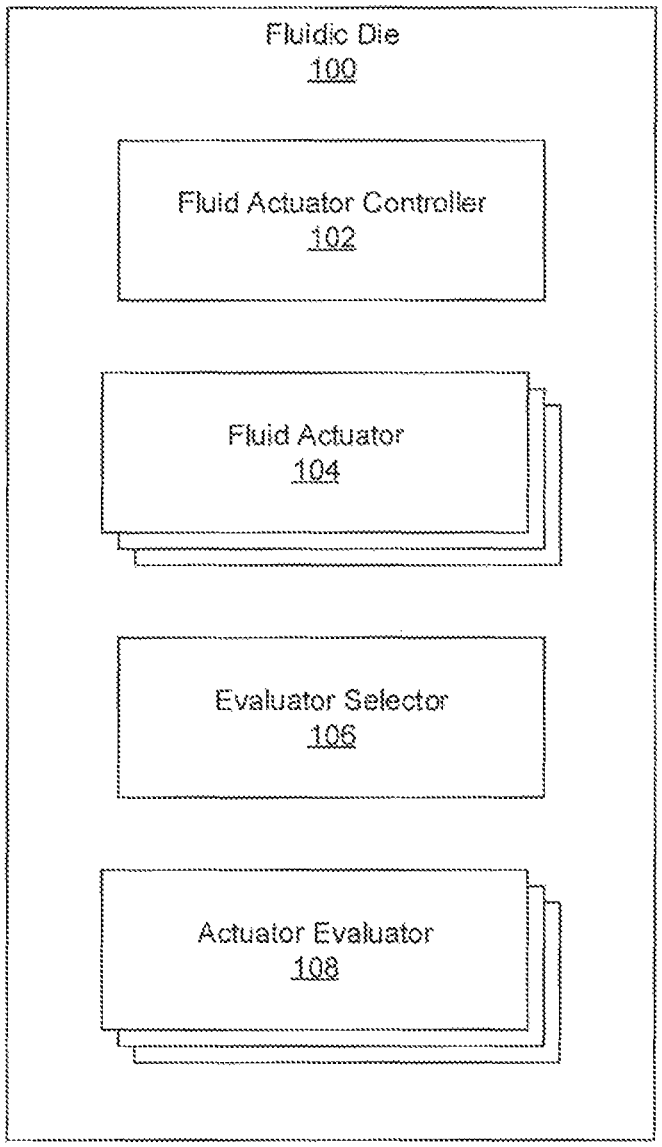
FIG. 1 is a block diagram of a fluidic die for fluid actuator evaluation independent of actuation state, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description: however, the description is not limited to the examples and/or implementations provided in the dialing.

DETAILED DESCRIPTION

Fluidic dies, as used herein, may describe a variety of types of integrated devices with which small volumes of fluid may be pumped, mixed, analyzed, ejected, etc. Such fluidic dies may include ejection dies, such as printheads, additive manufacturing distributor components, digital titration components, and/or other such devices with which volumes of fluid may be selectively and controllably ejected. Other examples of fluidic dies include fluid sensor devices, lab-on-a-chip devices, and/or other such devices in which fluids may be analyzed and/or processed.

In a specific example, these fluidic systems are found in any number of printing devices such as inkjet printers, multi-function printers (MFPs), and additive manufacturing apparatuses. The fluidic systems in these devices are used for precisely, and rapidly, dispensing small quantities of fluid. For example, in an additive manufacturing apparatus, the fluid ejection system dispenses fusing agent. The fusing agent is deposited on a build material which fusing agent facilitates the hardening of build material to form a three-dimensional product.

Other fluid ejection systems dispense ink on a two-dimensional print medium such as paper. For example, during Inkjet printing, fluid is directed to a fluid ejection die. Depending on the content to be printed, the device in which the fluid ejection system is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in two-dimensional printing, i.e., depositing fluid on a substrate, and in three-dimensional printing, i.e., depositing a fusing agent or other functional agent on a material base to form a three-dimensional printed product.

Returning to the fluid actuators, a fluid actuator may be disposed in a nozzle, where the nozzle includes a fluid chamber and a nozzle orifice in addition to the fluid actuator. The fluid actuator in this case may be referred to as an ejector that, upon actuation, causes ejection of a fluid drop via the nozzle orifice.

Fluid actuators may also be pumps. For example, some fluidic dies include microfluidic channels. A microfluidic channel is a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Fluidic actuators may be disposed within these channels which, upon activation, may generate fluid displacement in the microfluidic channel.

Examples of fluid actuators include a piezoelectric membrane based actuator, a thermal resistor based actuator, an electrostatic membrane actuator, a mechanical/impact driven membrane actuator, a magneto-strictive drive actuator, or other such elements that may cause displacement of fluid responsive to electrical actuation. A fluidic die may include a plurality of fluid actuators, which may be referred to as an array of fluid actuators.

The array of fluid actuators may be formed into groups referred to as "primitives." A primitive generally includes a group of fluid actuators that each have a unique actuation address. In some examples, electrical and fluidic constraints of a fluidic die may limit which fluid actuators of each primitive may be actuated concurrently for a given actuation event. Therefore, primitives facilitate addressing and subsequent actuation of fluid ejector subsets that may be concurrently actuated for a given actuation event.

A number of fluid ejectors corresponding to a respective primitive may be referred to as a size of the primitive. To illustrate by way of example, if a fluidic die has four primitives and each respective primitive has eight respective fluid actuators (the different fluid actuators having an address 0 to 7), the primitive size is eight. In this example, each fluid actuator within a primitive has a unique in-primitive address. In some examples, electrical and fluidic constraints limit actuation to one fluid actuator per primitive. Accordingly, a total of four fluid actuators (one from each primitive) may be concurrently actuated for a given actuation event. For example, for a first actuation event, the respective fluid actuator of each primitive having an address of 0 may be actuated. For a second actuation event, the respective fluid actuator of each primitive having an address of 1 may be actuated. In some examples, the primitive size may be fixed and in other examples the primitive size may vary, for example after the completion of a set of actuation events.

While such fluid ejection systems and dies undoubtedly have advanced the field of precise fluid delivery, some conditions impact their effectiveness. For example, the actuators on a die are subject to many cycles of heating, drive bubble formation, drive bubble collapse, and fluid replenishment from a fluid reservoir. Over time, and depending on other operating conditions, the actuators may become blocked or otherwise defective. As the process of depositing fluid on a surface is a precise operation, these blockages can have a deleterious effect on print quality. If one of these fluid actuators fail, and is continually operating following failure, then it may cause neighboring actuators to fail.

Accordingly, the present specification is directed to a fluidic die that 1) determines the state of a particular fluid actuator, 2) allows for varying or fixed primitive size, and 3) evaluates a state of a fluid actuator independent of an actuation state of the fluid actuator. That is, to actuate a fluid actuator, or set of fluid actuators, activation data is passed to the fluid actuator. The present specification decouples the evaluation of a fluid actuator from the activation of a fluid actuator.

Specifically, the present specification describes a fluidic die. The fluidic die includes an array of fluid actuators grouped into primitives. A fluid actuator controller selectively activates a subset of the array of fluid actuators. The fluidic die also includes an evaluation selector to, via a selection signal, select a fluid actuator to be evaluated independent of an actuation state for the fluid actuator. The fluidic die also includes an array of actuator evaluators. Each actuator evaluator is grouped with a subset of fluid actuators. The actuator evaluators evaluate a state of a selected fluid actuator based on 1) an output of an actuator sensor paired with the selected fluid actuator and 2) a selection signal for the selected fluid actuator.

In another example, a fluidic die includes an array of fluid actuators grouped into primitives, wherein one fluid actuator from each primitive is activated at a time. The fluidic die also includes an array of actuator sensors to generate a signal indicative of a state of a fluid actuator. Each actuator sensor is coupled to a respective fluid actuator. The fluidic die also includes a fluid actuator controller to selectively actuate a subset of the array of fluid actuators. The fluidic die also includes an evaluation selector to, via a selection signal, select a fluid actuator to be evaluated independent of an actuation state for the fluid actuator. On a fluidic die with variable primitive size, the evaluation selector includes an evaluation selection register that includes a respective selection bit for each respective fluid actuator to store evaluation selection data that indicates a set of fluid actuators to be evaluated. On a fluidic die with a fixed primitive size, the evaluation selector includes an evaluation selection register that includes a respective selection bit each primitive to store evaluation selection data that indicates a set of fluid actuators to be evaluated. The fluidic die also includes an array of actuator evaluators. Each actuator evaluator is grouped with a subset of fluid actuators from the array. The actuator evaluators evaluate a state of a selected fluid actuator based on 1) an output of an actuator sensor paired with the selected fluid actuator and 2) a selection signal for the selected fluid actuator.

The present application also describes a method. According to the method, an evaluation selector is populated with data to indicate which fluid actuators, independent of actuation state, are selected for evaluation. A fluid actuator is activated based on activation data to generate a sense voltage that is measured at a corresponding actuator sensor. The sense voltage is compared against an expected voltage when the actuator is indicated to be evaluated by an output of the evaluation selector.

In one example, using such a fluidic die 1) allows for actuator evaluation circuitry to be included on a die as opposed to sending sensed signals to actuator evaluation circuitry off die; 2) increases the efficiency of bandwidth usage between the device and die; 3) reduces computational overhead for the device in which the fluid ejection die is disposed; 4) provides improved resolution times for malfunctioning actuators; 5) allows for actuator evaluation in one primitive while allowing continued operation of actuators in another primitive; and 6) places management of nozzles on the fluid ejection die as opposed to on the printer in which the fluid ejection die is installed, 7) accommodates for variation in primitive size, and 8) evaluates fluid actuators independent of actuation state. However, it is contemplated that the devices disclosed herein may address other matters and deficiencies in a number of technical areas.

As used in the present specification and in the appended claims, the term "actuator" refers a nozzle or another non-ejecting actuator. For example, a nozzle, which is an actuator, operates to eject fluid from the fluid ejection die. A recirculation pump, which is an example of a non-ejecting actuator, moves fluid through the fluid slots, channels, and pathways within the fluid ejection die.

Accordingly, as used in the present specification and in the appended claims, the term "nozzle" refers to an individual component of a fluid ejection die that dispenses fluid onto a surface. The nozzle includes at least an ejection chamber, an ejector, and a nozzle orifice.

Further, as used in the present specification and in the appended claims, the term "fluidic die" refers to a component of a fluid ejection system that includes a number of fluid actuators. Groups of fluid actuators are categorized as "primitives" of the fluidic die, the primitive having a size referring to the number of fluid actuators grouped together. In one example, a primitive size may be between 8 and 16. The fluid ejection die may be organized first into two columns with 30-150 primitives per column.

Still further, as used in the present specification and in the appended claims, the term "actuation event" refers to a concurrent actuation of fluid actuators of the fluidic die to thereby cause fluid displacement.

Yet further as used in the present specification and in the appended claims, the term "activation data" refers to data that targets a particular fluid actuator or set of fluid actuators for actuation. For example, when primitive size varies, activation data may include per-actuator actuation data and mask data. In another example, when primitive size is fixed, activation data may include per-primitive actuation data and an address for a target fluid actuator.

Even further, as used in the present specification and in the appended claims, the term "a number of" or similar language is meant to be understood broadly as any positive number including 1 to infinity.

Turning now to the figures, FIG. 1 is a block diagram of a fluidic die (100) for fluid actuator evaluation independent of actuation state, according to an example of the principles described herein. As described above, the fluidic die (100) is part of a fluid ejection system that houses components for ejecting fluid and/or transporting fluid along various pathways. The fluid that is ejected and moved throughout the fluidic die (100) can be of various types including ink, biochemical agents, and/or fusing agents. The fluid is moved and/or ejected via an array of fluid actuators (104). Any number of fluid actuators (104) may be formed on the fluidic die (100).

The fluid actuators (104) may be of varying types. For example, the fluidic die (100) may include an array of nozzles, wherein each nozzle includes a fluid actuator (104) that is an ejector, in this example, a fluid ejector, when activated, ejects a drop of fluid through a nozzle orifice of the nozzle.

Another type of fluid actuator (104) is a recirculation pump that moves fluid between a nozzle channel and a fluid slot that feeds the nozzle channel. In this example, the fluidic die (100) includes an array of microfluidic channels. Each microfluidic channel includes a fluid actuator (104) that is a fluid pump. In this example, the fluid pump, when activated, displaces fluid within the microfluidic channel. While the present specification may make reference to particular types of fluid actuators (104), the fluidic die (100) may include any number and type of fluid actuators (104).

The fluid actuators (104) are grouped into primitives. As described above, a primitive refers to a grouping of fluid actuators (104) where each fluid actuator (104) within the primitive has a unique address. For example, within a first primitive, the first fluid actuator (104) has an address of 0, a second fluid actuator (104) has an address of 1, a third fluid actuator (104) has an address of 2, and a fourth fluid actuator (104) of the primitive has an address of 3. The fluid actuators (104) that are grouped into a second and third primitive respectively have similar addressing. While specific reference is made to three primitives, a fluidic die (100) may include any number of primitives having any number of fluid actuators (104) disposed therein. In some cases, a quantity of fluid actuators (104) within the primitive that can be concurrently fired may be designated. For example, it may be designated that in a given primitive, one fluid actuator (104) is enabled at a time.

The fluidic die (100) also includes a fluid actuator controller (102) to selectively activate fluid actuators (104). That is, the fluid actuator controller (102) receives a fire signal, which is selectively passed to select fluid actuators (104) based on activation data. Put another way, the activation data gates a fire signal to pass to a desired primitive and fluid actuator (104).

The activation data may take many forms. For example, the number of fluid actuators (104) within a primitive may vary. If the number of fluid actuators (104) within a primitive is not fixed, i.e., it varies, then the activation data may include 1) actuator data that indicates a set of fluid actuators (104) to activate for a set of actuation events and 2) mask data that indicates fluid actuators (104) to activate for a particular activation event.

In the case where the number of fluid actuators (104) within a primitive is fixed, then the activation data may include a first signal that activates the entire primitive, and an address that targets a particular fluid actuator (104) within the primitive.

The fluidic die (100) also includes an evaluation selector (106) to, via a selection signal, select a fluid actuator (104) to be evaluated. This selection signal is independent of an actuation state for the fluid actuator (104). That is, the determination as to whether a particular fluid actuator (104) is to be evaluated is performed independently of actuation data.

The fluidic die (100) also includes an array of actuator evaluators (108). Each actuator evaluator (108) is coupled to a subset of fluid actuators (104) of the array. The subset of fluid actuators (104) that are coupled to a particular actuator evaluator (108) may include any number including one.

The actuator evaluators (108) evaluate a state of any fluid actuator (104) within the subset that pertains to that actuator evaluator (108) and generates an output indicative of the fluid actuator (104) state. Note that the primitive grouping does not necessarily align with the group of fluid actuators (104) that are coupled to an actuator evaluator (108).

The evaluation of a fluid actuator (104) is based on various components. For example, the actuator evaluator (108) is activated via an evaluation control signal. That is, when it is desired that an actuator analysis be performed on a particular fluid actuator (104) or set of fluid actuators (104), an evaluation control signal is passed, which indicates that an evaluation of a particular fluid actuator is desired.

The actuator evaluation is also based on the selection signal for the selected fluid actuator (104). For example, if a fluid actuator (104) grouped with the actuator evaluator (108) is indicated for evaluation via the selection signal, then the actuator evaluator (108) evaluates that fluid actuator (104). The evaluation of a stare of the fluid actuator (104) is based on an output of an actuator sensor that is paired with the selected fluid actuator.

Note that the activation of an actuator evaluator (108) is independent of any data that activates a particular fluid actuator (104). That is, the actuation data that is passed to a fluid actuator (104) that causes the fluid actuator (104) to eject or move fluid throughout the fluidic die (100) is distinct and independent of the signals that trigger the actuator evaluation. That is, the subset of the array of fluid actuators that are to be activated may differ from the fluid actuators that are selected for evaluation.

Such a fluidic die (100) is efficient in that it allows for selection of a fluid actuator (104) for evaluation independent of per-primitive or per-actuator activation data. Such independent control allows for actuator evaluation based on real-time image data, thus avoiding allocating dedicated time slices for actuator evaluation. That is, actuation data collected during printing can be used at a later point in time. Accordingly, evaluation of a fluid actuator (104) does not rely on a dedicated actuation event, but can hold, and store, actuation data and use it later, based on an evaluation control signal.

Figure 2:
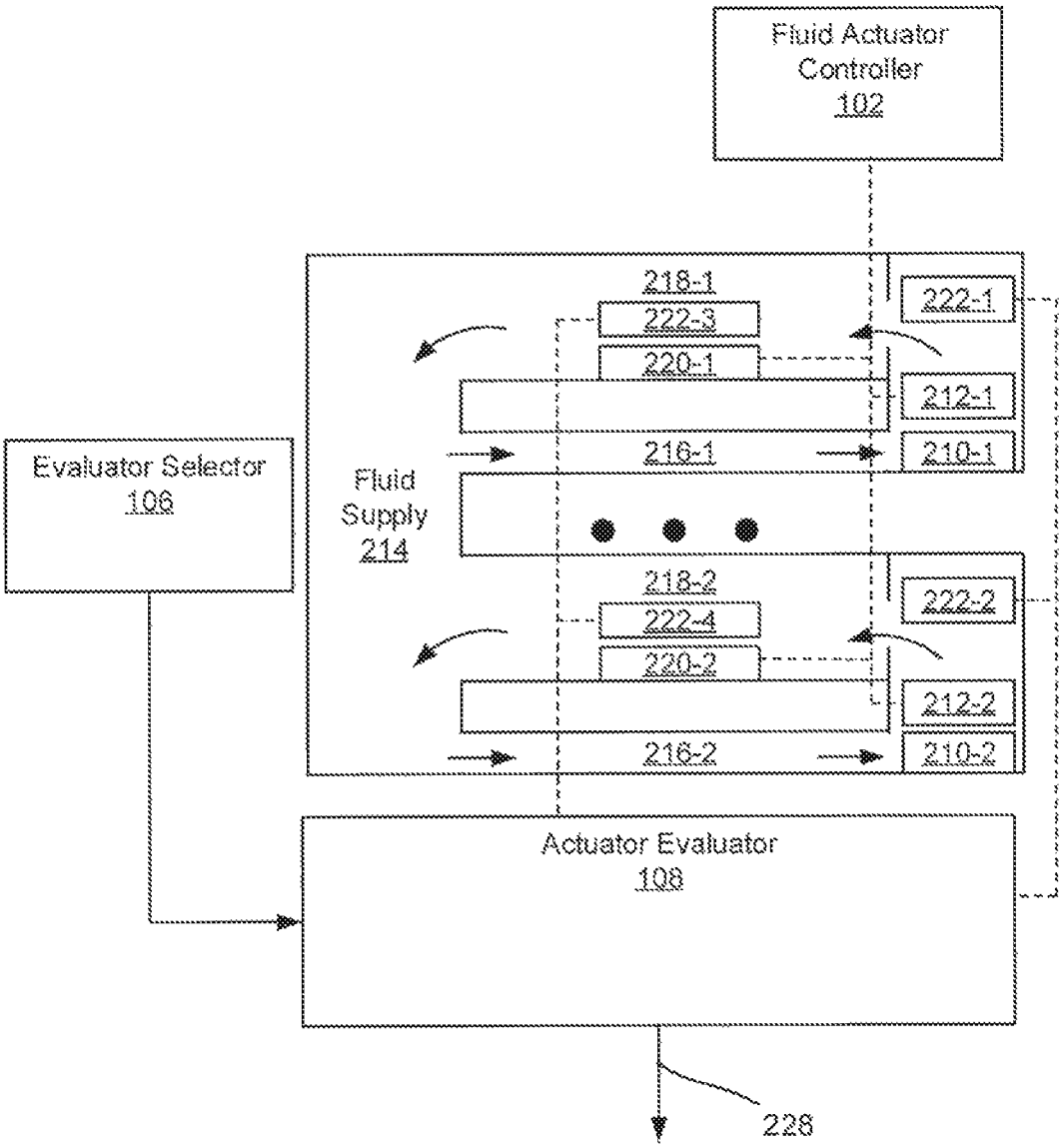
FIG. 2 is a diagram of a fluidic die for fluid actuator evaluation independent of actuation state, according to an example of the principles described herein.

FIG. 2 is a diagram of a fluidic die (100) for fluid actuator evaluation independent of actuation state, according to another example of the principles described herein. Specifically, FIG. 2 depicts the fluid actuator controller (102), one subset of fluid actuators (FIG. 1, 104), and an evaluator selector (106) coupled to an actuator evaluator (108). While FIG. 2 depicts two structures, a primitive may include any number of structures. In FIG. 2, fluid flow throughout the fluidic die (100) is indicated by the arrows.

As described above, the fluid actuators (FIG. 1, 104) may take many forms. For example, the fluidic die (100) may include a plurality of nozzles where each nozzle includes an ejection chamber, a nozzle orifice (210), and a fluid actuator (FIG. 1, 104) in the form of a fluid ejector (212). As shown, each nozzle may be fluidly connected to a fluid supply (214) via a fluid input (216). In addition, each nozzle may be fluidly connected to the fluid supply (218) via a microfluidic channel (218) in which a fluid actuator (FIG. 1, 104) in the form of a fluid pump (220) is disposed.

In this example, fluid is conveyed to the ejection chamber of each nozzle via the respective fluid input (216-1, 216-2).

Actuation of the fluid ejectors (212-1, 212-2) of each nozzle may displace fluid in the ejection chamber in the form of a fluid drop ejected via the nozzle orifices (210-1, 210-2). Furthermore, fluid may be circulated from the ejection chamber back to the fluid supply (214) via microfluidic channels (218-1, 218-2) by operation of the fluid pumps (220-1, 220-2) disposed therein.

Accordingly, in such examples actuation of the fluid actuators (FIG. 1, 104) (e.g., fluid ejectors (212) and fluid pumps (220)) is carried out by the fluid actuator controller (102). In this example, the fluid actuator controller (102) includes components to manage the actuation of the various fluid actuators (FIG. 1, 104).

The fluidic die (100) also includes an evaluator selector (106) to allow evaluation of a particular fluid actuator (FIG. 1, 104). Once a particular fluid actuator (FIG. 1, 104), i.e., fluid pump (220) or fluid ejector (212), has been selected via the evaluator selector (106), a corresponding sensor (222-1, 222-2, 222-3, 222-4) collects information regarding the state. For example, in a drive bubble detection system, the sensors (222-1, 222-2, 222-3, 222-4) detect a voltage, and pass the corresponding voltage to the actuator evaluator (108) for state determination. That is, the actuator evaluator (108) can determine a state, for example failing or operational, of any fluid actuator (FIG. 1, 104) coupled thereto. Note, that as depicted in FIG. 2, in some examples, the actuator sensors (222) are uniquely paired with a corresponding fluid actuator (FIG. 1, 104), i.e., fluid pump (220) and/or fluid ejector (212) and that a single actuator evaluator (108) is shared among all the fluid actuators (FIG. 1, 104) within the subset.

The actuator evaluator (108) includes various components to determine a state of the fluid actuator (FIG. 1, 104). In one example, the actuator evaluator (108) may include a compare device to compare an output of an actuator sensor (222) coupled to a respective fluid actuator (FIG. 1, 104) against a threshold value to determine the state of the respective fluid actuator (FIG. 1, 104). That is, the compare device determines whether the output of the actuator sensor (222), $V_o$, is greater than or less than the threshold voltage. $V_{th}$. The compare device then outputs a signal indicative of which is greater. Still in this example, the output of the compare device may then be passed to a storage device of the actuator evaluator (108). In one example, the storage device may be a latch device that stores the output of the compare device and selectively passes the output on. While specific reference is made to the compare device and storage device being within the actuator evaluator (108), in some examples, the compare device and/or storage device may be disposed elsewhere, for example on a line leading out of the actuator evaluator (108). While specific reference is made to evaluation by comparison, other types of evaluation may occur, such as comparison of sense voltages from a sensor (222) over time.

In another example, the actuator evaluator (108) receives a sense voltage and outputs it to an A/D controller to convert the sense voltage to a digital count, which digital count is then sent to an off-die printer system electronic for evaluation and analysis. In other words, in the first example, analysis of the sense voltage may occur at the actuator evaluator (108) and in other examples the actuator evaluator (108) receives the signal and conveys if to another system for analysis.

In some examples, the output line (228) is a shared line along which outputs of multiple actuator evaluators (108) are passed. That is, the output line (228) may be a single wire or bus of wires that is connected to all actuator evaluators (108). This output line (228) may be coupled to a sample device. In this example, the actuator evaluators (108) are controlled such that one actuator evaluator (108) actively drives its sample voltage on the output line (228) at a time. Still further, the sample device receives and stores the sample voltage at the appropriate time.

The output line (228) may transmit various pieces of information regarding a state of the evaluated fluid actuator (FIG. 1,108). In one example, just an output of the actuator sensor (222) is passed along the output line (228) and a subsequent controller may include components to associate a particular actuation event with the corresponding evaluation event. That is, there is a built in delay between actuation of a particular fluid actuator (FIG. 1, 104) and evaluation of that fluid actuator (FIG. 1, 104). This delay may be on the order of 10 microseconds. However, other fluid actuators (FIG. 1, 104) may be actuated multiple times during that delay. Accordingly, to ensure accurate evaluation, there should be an association between an actuation and the evaluation resulting from the actuation. Accordingly, the output line (228) may pass just the evaluation results, and a subsequent controller may perform calculations to determine the association.

In another example, in addition to passing the evaluation results, the output line (228) may pass an identification of the actuator (FIG. 1, 104) that was evaluated. In other words, the actuator evaluator (108) associates the state of the fluid actuator (FIG. 1, 104) with an address of the fluid actuator (FIG. 1, 104). In this example, a downstream controller would not have to perform the calculations to determine the association.

Figure 3:
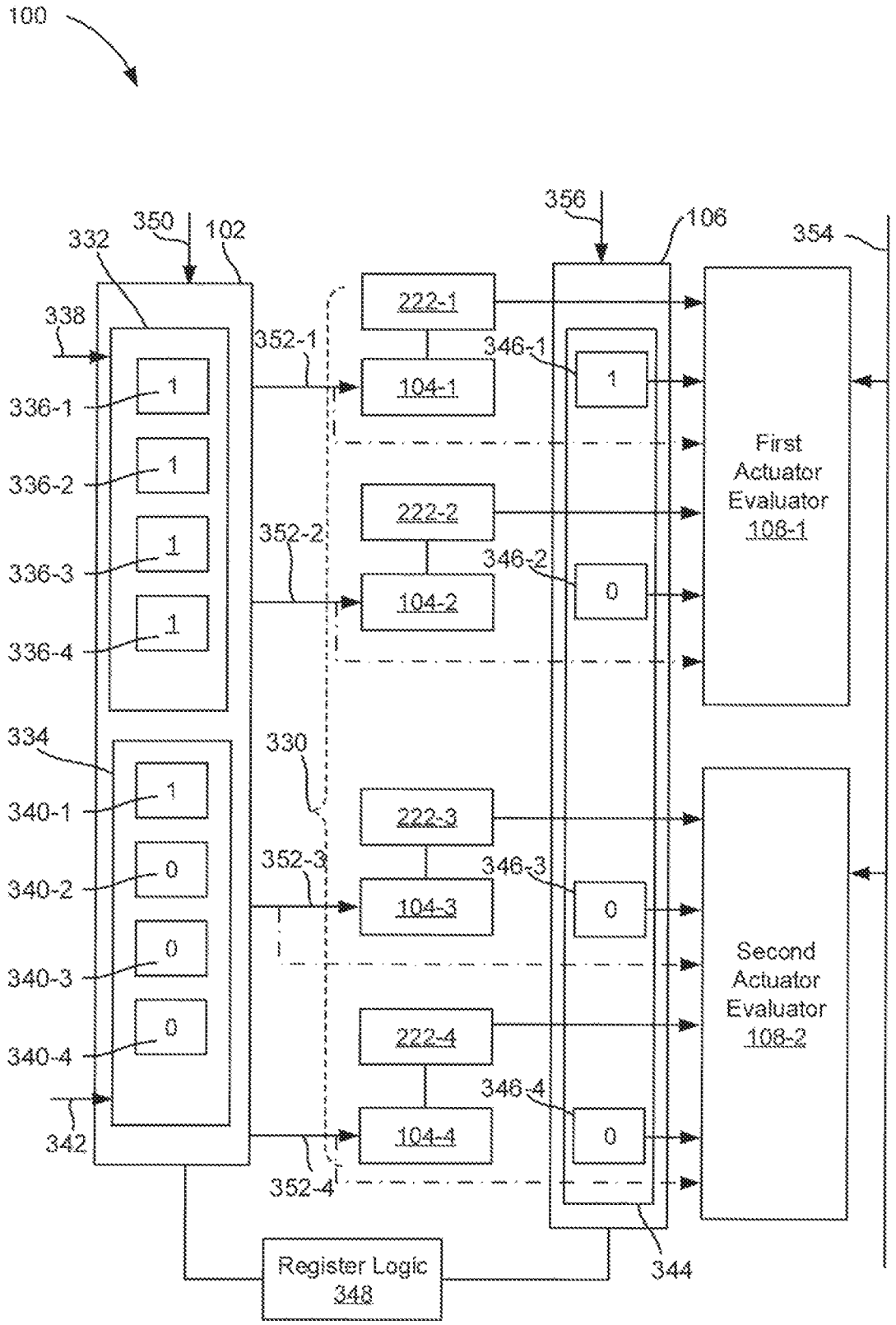
FIG. 3 is a diagram of a fluidic die for fluid actuator evaluation independent of actuation state, according to another example of the principles described herein.

FIG. 3 is a diagram of a fluidic die (100) for fluid actuator (104) evaluation independent of actuation state, according to another example of the principles described herein. Specifically. FIG. 3 depicts a scenario where the primitive (330) size varies.

In this example, the fluid actuator controller (102) includes an actuation data register (332) and a mask register (334). The actuation data register (332) stores actuation data that indicates fluid actuators (104) to actuate for a set of actuation events. For example, the actuation data register (332) may include a set of actuation bits (336) to store actuation data, where each respective actuation bit (336-1, 336-2, 336-3, 336-4) of the actuation data register (332) corresponds to a respective fluid actuator (104-1 through 104-4). For those fluid actuators (104) that are to be actuated for a set of actuation events, the corresponding actuation bit (336) can be set to one. For those fluid actuators (104) that are not to be actuated for the set of actuation events, the corresponding actuation bit (336) can be set to zero. In the example, depicted in FIG. 3, all of the fluid actuators (104) have been activated for a set of actuation events as indicated by each having the actuation bit (336-1, 336-2, 336-3, 336-4) value set to "1." In this example, the actuation data register (332) is populated with actuation bits (336) via an input signal (338).

The mask register (334) stores mask data that indicates a subset of fluid actuators (104) of the array of fluid actuators (104) enabled for actuation for a particular actuation event of the set of actuation events. For example, the mask register (334) may include a set of mask bits (340) to store mask data, where each respective mask bit (340-1, 340-2, 340-3, 340-4) of the mask register (334) corresponds to a respective fluid actuator (104-1 through 104-4). For those fluid actuators (104) that are to be actuated for a particular actuation event, the corresponding respective mask bit (340-1, 340-2, 340-3, 340-4) can be set to one. For those fluid actuators (104) that are not to be actuated for the particular actuation events, the corresponding respective mask bit (340) can be set to zero.

In so doing, the mask register (334) configures the size of the primitives (330). In the example depicted in FIG. 3, the first fluid actuator (104-1) has been activated for a particular actuation event as indicated by the respective mask bit (340-1) value set to "1." By comparison, the second, third, and fourth fluid actuators (104-2, 104-3, 104-4) have not been activated for a particular actuation event as indicated by the respective mask bits (340-2, 340-3, 340-4) value set to "0." In so doing, the mask register (334) configures the size of the primitives (330) That is, the mask register (330) identifies the first fluid actuator (106-1) to be activated for a particular actuation event. Accordingly, the primitive (330) size is established by the mask register (334) to be four fluid actuators. While FIG. 3 depicts a primitive (330) having four fluid actuators (104-1, 104-2, 104-3, 104-4), the primitive (330) may have any number of fluid actuators (104), which number may vary over time. In this example, the mask register (334) is populated with mask data (340) via an input signal (342).

Note that over time, the primitive (330) size may change based on the information presented in the mask register (334). That is, the primitive (330) size is not fixed. At different points in time, the mask data may change, such that the fluid actuator controller (102) facilitates variable primitive (330) sizes. For example, for a first set of actuation events, fluid actuators (104) may be arranged in primitives (330) of a first primitive size, as defined by first mask data stored in the mask register (334), and for a second set of actuation events, second mask data may be loaded into the mask register (334) such that fluid actuators (104) may be arranged in primitives (330) of a second primitive size.

Accordingly, the fluid actuator controller (102) facilitates concurrent actuation of different arrangements of fluid actuators (104) based on the mask data of the mask register (334).

In some examples, the evaluator selector (106) includes an evaluation selection register (344) that indicates a subset of fluid actuators (104) of the array of fluid actuators (104) enabled for evaluation. For example, the evaluation selection register (344) may include a set of evaluation selection bits (346) to store evaluation selection data, where each respective evaluation selection bit (346-1, 346-2, 346-3, 346-4) of the evaluation selection register (344) corresponds to a respective fluid actuator (104-1 through 104-4). For those fluid actuators (104) that are to be evaluated, the corresponding respective evaluation selection bit (346-1, 346-2, 346-3, 346-4) can be set to one. For those fluid actuators (104) that are not to be evaluated for the particular evaluation event, the corresponding respective evaluation selection bit (346) can be set to zero. A particular fluid actuator (104) is evaluated when the corresponding respective selection bit (346) is set to one. That is, the evaluator selector (106) outputs a selection signal per selected fluid actuator. Specifically in regards to the example depicted in FIG. 3, as the respective evaluation selection bit (346-1) corresponding to the first fluid actuator (104-1) is active, then the first actuator evaluator (108-1) will evaluate the first fluid actuator (104-1).

The fluidic die (102) may also include register logic (348). The register logic (348) shifts mask data stored in the mask register (334) responsive to the performance of a particular actuation event of a set of actuation events. By shifting the mask data, different fluid actuators (104) are indicated for actuation of a subsequent actuation event of the set of actuation events. To effectuate such shifting, the mask control logic may include a shift count register to store a shift pattern that indicates a number of shifts that are input into the mask register (334) and a shift state machine which inputs a shift clock to cause the shifting indicated in the shift count register.

The register logic (348) also shifts evaluation selection data stored in the evaluation register (344) responsive to the performance of a particular evaluation event. By shifting the evaluation selection data, different fluid actuators (104) are indicated for evaluation of a different evaluation event. While the fluidic die (102) indicates the register logic (348) as a single component, the register logic (348) may be broken up into various components, including logic disposed within the fluid actuator controller (102) and logic disposed within the evaluator selector (106).

As described above, fluid actuators (104) are activated via activation data. That is, a fire signal (350) is passed to the fluid actuator controller (102) and then a particular fluid actuator (104) is selected via actuation data and mask data.

When a selected fluid actuator (104) is selected via the activation data, the particular fluid actuator is activated via a local per-actuator fire signal (352-1, 352-2, 352-3, 352-4) which is the fire signal (328) gated by the actuation data and mask data. Once a particular actuator (104) has been activated, the corresponding actuator sensors (222) generates a signal indicative of a state of the fluid actuator (104). For example, a first actuator sensor (222-1) is paired with, and generates a signal indicative of a state of a first fluid actuator (104-1). Similarly, the second, third and fourth actuator sensors (222-2, 222-3, 222-4) are paired with, and generate signals indicative of a state of a second, third and fourth fluid actuator (104-2, 104-3, 104-4), respectively. Accordingly, once a particular fluid actuator (104), i.e., fluid pump or fluid ejector, has been activated, a corresponding sensor (222) collects information regarding the state of that fluid actuator (104).

As a specific example, the actuator sensors (222) may be drive bubble detectors that detect the presence of a drive bubble within a chamber in which the fluid actuator (104) is disposed. That is, a drive bubble is generated by a fluid actuator (104) to move fluid.

As a specific example, in thermal inkjet printing, a thermal ejector heats up to vaporize a portion of fluid in an ejection chamber. As the bubble expands, it forces fluid out of a nozzle orifice or through a microfluidic channel. As the bubble collapses, a negative pressure within the ejection chamber draws fluid from the fluid feed slot of the fluidic die (100). Sensing the proper formation and collapse of such a drive bubble can be used to evaluate whether a particular fluid actuator (104) is operating as expected. That is, a blockage will affect the formation of the drive bubble. If a drive bubble has not formed as expected, it can be determined that the chamber is blocked and/or not working in the intended manner.

The presence of a drive bubble can be detected by measuring impedance values within the chamber at different points in time. That is, as the vapor that makes up the drive bubble has a different conductivity than the fluid that otherwise is disposed within the chamber, when a drive bubble exists in the chamber, a different impedance value will be measured. Accordingly, a drive bubble detection device measures this impedance and outputs a corresponding voltage. As will be described below, this output can be used to determine whether a drive bubble is properly forming and therefore determining whether the corresponding nozzle or pump is in a functioning or malfunctioning state. This output can be used to trigger subsequent fluid actuator (104) management operations. While description has been provided of an impedance measurement, other characteristics may be measured to determine the characteristic of the corresponding fluid actuator (104).

The drive bubble detection devices may include a single electrically conductive plate, such as a tantalum plate, which can detect impedance of whatever medium is in contact with the plate in the chamber, which impedance measure can indicate whether a drive bubble is present in the chamber. The drive bubble detection device then outputs a first voltage value indicative of a state, i.e., drive bubble formed or not, of the corresponding fluid actuator (104). This output can be compared against a threshold voltage to determine whether the fluid actuator (104) is malfunctioning or otherwise inoperable. Note, that as depicted in FIG. 3, in some examples, the actuator sensors (222) are uniquely paired with a corresponding fluid actuator (104), i.e., fluid pump and/or fluid ejector and that a single actuator evaluator (108) is shared among all the fluid actuators (104) within the subset.

With a state detected, the corresponding sensor (222-1, 222-2, 222-3, 222-4) sends an output to the corresponding actuator evaluator (108-1, 108-2). If the actuator evaluator (108-1, 108-2) has been selected via the evaluation control signal (354) and a selection signal for a particular fluid actuator (104) received, the fluid actuator (104) is evaluated.

A specific example is now presented in which the first fluid actuator (104-1) is to be evaluated. Via an input signal (356), the evaluation selection register (344) is populated with information indicating the first fluid actuator (104-1) is to be evaluated. In other words, the first evaluation selection bit (346-1) in the evaluation selection register (344), which corresponds to the first fluid actuator (104-1) is set to a value of 1. Doing so couples the first sensor (222-0 to the first actuator evaluator (108-1). Accordingly, the first sensor (222-1) senses a state of the first fluid actuator (104-1) and passes it to the first actuator evaluator (108-1) for evaluation. In one example of evaluation, the output of the sensor (222-1) could be compared to a threshold value to determine whether a drive bubble has formed in the fluid actuator (104) as expected. In yet another example, the fluid actuator (104) may remain selected until it is fired during a subsequent actuation event. In this example, evaluation of the actuator state is further based on the activation data directed to the selected fluid actuator (104) which signal is indicated by a dashed line in FIG. 3.

As the evaluation of a fluid actuator (104), controlled by the evaluation selection register (344) may be independent of the activation of a fluid actuator (104), it may be the case that a fluid actuator (104) selected for evaluation has not been activated. In this scenario, the actuator evaluator (108) could compare an output of the corresponding sensor (222) against a first expected output, which first expected output represents an expected output when no firing event has occurred. By comparison, when the fluid actuator (104) to be evaluated has been activated, the actuator evaluator (108) compares an output of the corresponding actuator sensor (222) against a second expected output, which second expected output reflects an output expected when a firing event has occurred.

Figure 4:
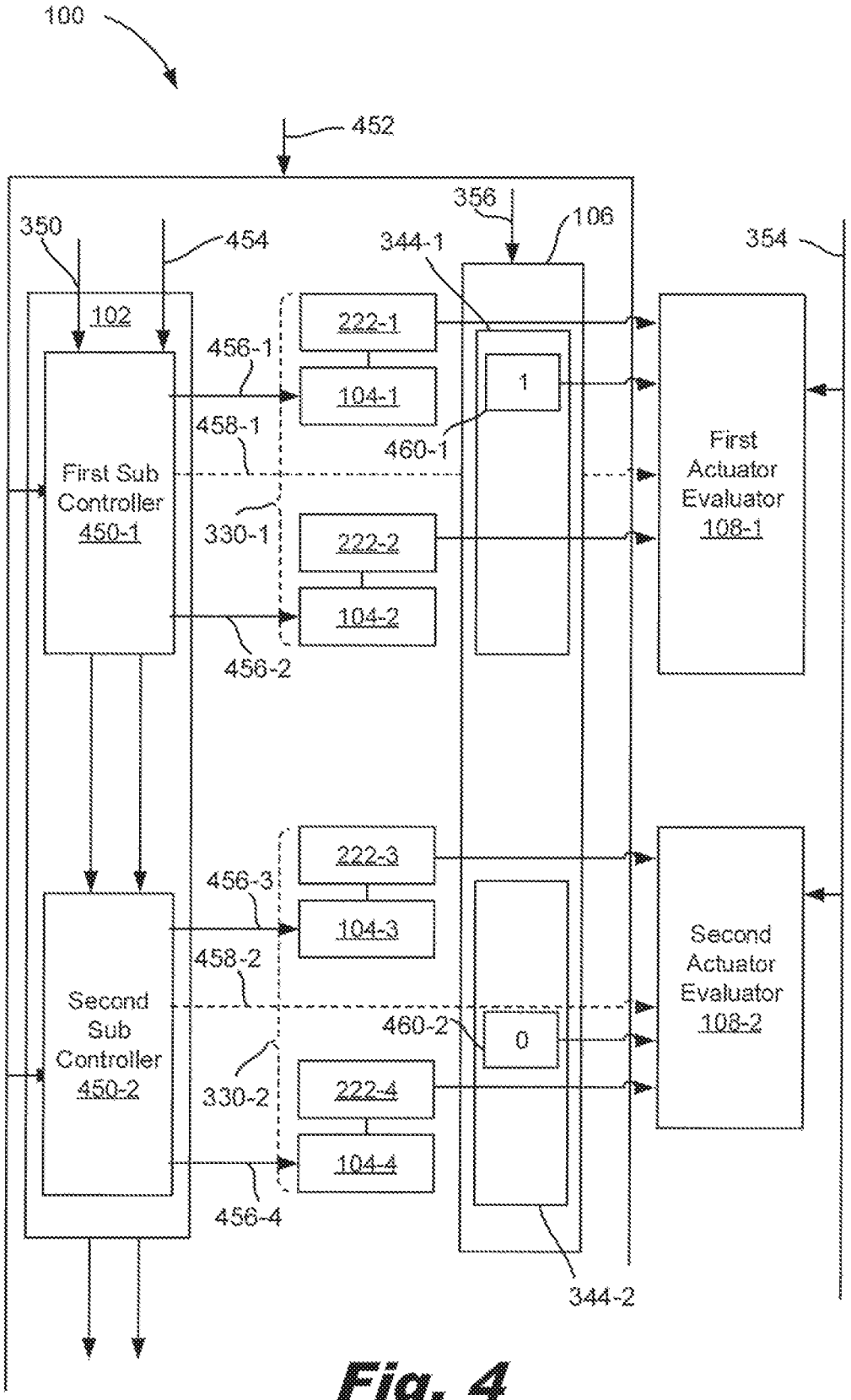
FIG. 4 is a diagram of a fluidic die for fluid actuator evaluation independent of actuation state, according to another example of the principles described herein.

FIG. 4 is a diagram of a fluidic die (100) for fluid actuator evaluation independent of actuation state, according to another example of the principles described herein. Specifically, FIG. 4 depicts a scenario where the number of fluid actuators (104) within a primitive (330) is fixed. That is, FIG. 4 depicts a first primitive (330-1) having two fluid actuators (104-1, 104-2) and a second primitive (330-2) having two fluid actuators (104-3, 104-4). While FIG. 4 depicts two primitives (330) with two fluid actuators (104) each, a primitive (330) may have any number of fluid actuators (104). In this example, the number of fluid actuators (104) within a primitive does not change over time.

In this example, where the number of fluid actuators (104) in a primitive (330) are fixed, the fluid actuator controller (102) includes sub-controllers (450) per primitive (33Q). That is, a first sub-controller (450-1) controls a first primitive (330-1), and a second sub-controller (450-2) controls a second primitive (330-2). As described above, fluid actuators (104) are activated via activation data. That is, a fire signal (350) is passed to all sub-controllers (450), but just these primitives (330-1) that are selected are activated. Accordingly, per-primitive actuation data (454) is shifted down through the sub-controllers (450-1) and a particular sub-controller (450) is activated when indicated by the per-primitive actuation data (454). A particular actuator (104) of that primitive (330) is targeted via an address (452) passed to the first sub-controller (450-1). That is, if a first actuator (104-1) of the first primitive (330-1) is to be activated, a per-primitive actuation data (454) is passed that activates the first primitive (330-1), and an address (452) passed that targets the first fluid actuator (104-1). In other words, the activation data that activates a particular fluid actuator includes 1) the per-primitive actuation data (454) that activates the corresponding primitive and 2) an address (452) for a particular fluid actuator (104) to be actuated.

When a selected primitive (330-1, 330-2) is selected via the per-primitive actuation data (454) and a particular fluid actuator (104-1, 104-2, 104-3, 104-4) is selected via an address (452), the particular fluid actuator is activated via a local fire signal (456-1, 456-2, 456-3, 456-4) which is the fire signal (350) gated by the per-primitive actuation data signal (454) and address (452).

Once a particular fluid actuator (104) has been selected, the corresponding sensor (222-1, 222-2, 222-3, 222-4) sends an output to the corresponding actuator evaluator (108-1, 108-2). If the actuator evaluator (108-1, 108-2) has been selected via the evaluation control signal (354) and a primitive fire signal (458-1, 458-2), and a selection signal for a particular fluid actuator (104) received, then the particular fluid actuator (104) as identified by the address (452) is evaluated. The primitive fire signal (222-1) may reflect the first signal (212) that is gated by the corresponding sub-controller (208-1).

In the case where the primitive (330) size is fixed, the evaluation selection register (344) indicates a primitive (330) enabled for evaluation. For example, the evaluation selection register (344) may Include a set of evaluation selection bits (460) to store evaluation selection data, where each respective evaluation selection bit (460-1, 460-2) of the evaluation selection register (334) corresponds to a respective primitive (330-1). This respective evaluation selection bit (460) along with the address (452) of a particular fluid actuator (104) allows for evaluation of a selected fluid actuator (104).

A specific example is now presented in which the second fluid actuator (104-2) is to be evaluated. Via an input signal (356), the evaluation selection register (344) is populated with information indicating the first primitive (330-1) is to be evaluated. In other words, the respective evaluation selection bit (460-1) in the evaluation selection register (344) that is active, couples the sensors (222) in the first primitive (330-1) to the first actuator evaluator (108-1). Accordingly, the second sensor (222-2) senses a state of the second fluid actuator (104-2) and passes it to the first actuator evaluator (108-1) for evaluation. Having received the sense output and the address (452) the first actuator evaluator (108-1) evaluates the second fluid actuator (104-2). For example, the output of the second sensor (222-2) could be compared to an expected value to determine whether a drive bubble has formed in the fluid actuator (104) as expected. In other words, evaluation in a fixed primitive (330) scenario is based on the selection signal from the evaluator selector (106), the sense voltage from the corresponding actuator sensor (222), and the address (452) of a targeted fluid actuator (104).

Figure 5:
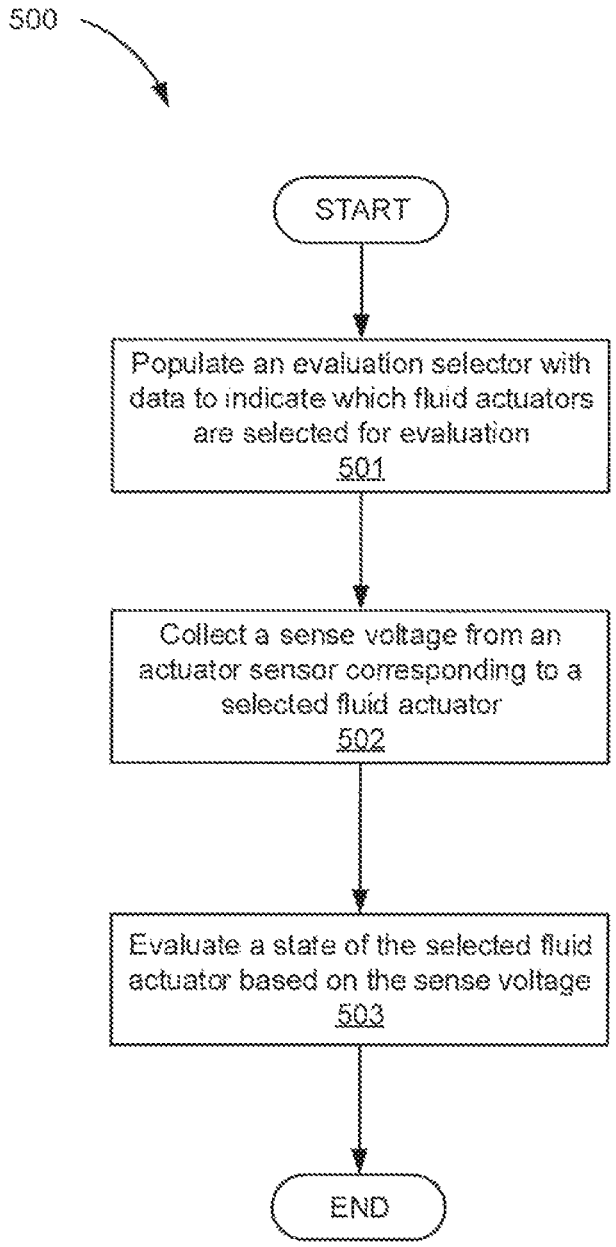
FIG. 5 is a flow chart of a method for fluid actuator evaluation independent of actuation state, according to an example of the principles described herein.

FIG. 5 is a flow chart of a method (500) for fluid actuator (FIG. 1, 104) evaluation independent of actuation state, according to an example of the principles described herein. According to the method (500), an evaluation selector (FIG. 1, 106) is populated (block 501) with data to indicate which fluid actuators (FIG. 1, 104) are selected for evaluation. For example, as described above, the evaluation selector (FIG. 1, 106) includes an evaluation selection register (FIG. 3, 344) that can include per-actuator evaluation selection bits (FIG. 3, 346-4) to indicate a particular fluid actuator (FIG. 1, 104) to be evaluated, or can be include per-primitive evaluation selection bits (FIG. 4, 460) that indicate a primitive (FIG. 3, 330) and, when considered along with an address (FIG. 4, 452) for a particular actuator (FIG. 1, 104) can indicate a particular fluid actuator to be evaluated. Accordingly, in either case, the evaluation selector (FIG. 1, 106) is populated with the data to indicate either a specific fluid actuator (FIG. 1, 104) to evaluate or a primitive (FIG. 3, 330) to which a target fluid actuator (FIG. 1, 104) is associated.

A sense voltage is collected (block 502) that corresponds to the selected fluid actuator (FIG. 1, 104). In some examples, the collection of the sense voltage may be responsive, or not, to a fire signal. For example, as stated above, in some examples, a sense voltage is collected when a firing event has not occurred, and this sense voltage is compared against a first expected output that is an expected output when no firing event has occurred. By comparison, in some examples, a sense voltage is collected responsive to a fire signal, and the resulting sense voltage is compared against a second expected output that is an expected output when a firing event has occurred. In some examples, the analysis of the sense voltage occurs at the actuator evaluator (FIG. 1, 108). In other examples, the actuator evaluator (FIG. 1, 108) collects the sense voltage and conveys it to another system for analysis.

An actuator state is then evaluated (block 503) based on the sense voltage. In some examples, evaluating (block 503) a state of the fluid actuator (FIG. 1, 104) includes comparing the sense voltage, i.e., the output of the sensor (FIG. 2, 222) against a threshold voltage. In this example, the threshold voltage may be selected to clearly indicate a blocked, or otherwise malfunctioning, fluid actuator (FIG. 1, 104). That is, the threshold voltage may correspond to an impedance measurement expected when a drive bubble is present in the chamber, i.e., the medium in the chamber at that particular time is fluid vapor. Accordingly, if the medium in the chamber were fluid vapor, then the received sense voltage would be comparable to the threshold voltage. By comparison, if the medium in the chamber is print fluid such as ink, which may be more conductive than fluid vapor, the impedance would be lower, thus a lower voltage would be present. Accordingly, the threshold voltage is configured such that a voltage lower than the threshold indicates the presence of fluid, and a voltage higher than the threshold indicates the presence of fluid vapor. If the sense voltage is thereby greater than the threshold voltage, it may be determined that a drive bubble is present and if the sense voltage is lower than the threshold voltage, it may be determined that a drive bubble is not present when it should be, and a determination made that the fluid actuator (FIG. 1, 106) is not performing as expected. While specific reference is made to output a low voltage to indicate low impedance, in another example, a high voltage may be output to indicate low impedance.

In another example, evaluating (block 503) a state of the fluid actuator (FIG. 1, 104) includes passing multiple instances of the sense voltage to a controller for analysis. In this example, the multiple instances, received over time, may be analyzed to determine a trend as to whether the fluid actuator (FIG. 1, 104) is tending towards failure.

In one example, using such a fluidic die 1) allows for actuator evaluation circuitry to be included on a die as opposed to sending sensed signals to actuator evaluation circuitry off die: 2) increases the efficiency of bandwidth usage between the device and die; 3) reduces computational overhead for the device in which the fluid ejection die is disposed; 4) provides improved resolution times for malfunctioning actuators; 5) allows for actuator evaluation in one primitive while allowing continued operation of actuators in another primitive; and 6) places management of nozzles on the fluid ejection die as opposed to on the printer in which the fluid ejection die is installed, 7) accommodates for variation in primitive size, and 8) evaluates fluid actuators independent of actuation state. However, it is contemplated that the devices disclosed herein may address other matters and deficiencies in a number of technical areas.

The preceding description has been presented to illustrate and describe examples of the principles described. This description is net intended to be exhaustive or to limit these principles to any precise form disclosed. Many modifications and variations are possible in light of the above teaching.

What is claimed is:

1. A fluidic die comprising:

an array of fluid actuators grouped into primitives;

a fluid actuator controller to selectively actuate a subset of the array of fluid actuators;

an evaluation selector to, via a selection signal, select a fluid actuator to be evaluated independent of an actuation state for the fluid actuator; and an array of actuator evaluators, each actuator evaluator grouped with a subset of fluid actuators from the array, to evaluate an actuator state of a selected fluid actuator based on:

an output of an actuator sensor paired with the selected fluid actuator; and a selection signal for the selected fluid actuator.

2. The fluidic die of claim 1, wherein:

a size of each primitive is variable; and the fluid actuator controller comprises:

an actuation data register to store actuation data that indicates fluid actuators to actuate for a set of actuation events; and a mask register comprising a respective bit for each respective fluid actuator to store mask data that indicates a set of fluid actuators of the array enabled for actuation for a particular actuation event of the set of actuation events.

3. The fluidic die of claim 2, wherein:

the evaluation selector:

includes an evaluation selection register that comprises a respective selection bit for each fluid actuator; and is to output a selection signal per selected fluid actuator.

4. The fluidic die of claim 3, wherein evaluation of the actuator state is further based on an actuation signal directed to the selected fluid actuator.

5. The fluidic die of claim 1, wherein:

a size of each primitive is fixed;

the fluid actuator controller comprises a sub-controller per primitive to activate a corresponding primitive for a particular actuation event via a per-primitive actuation data; and each sub-controller receives an address to indicate a particular fluid actuator per primitive to activate.

6. The fluidic die of claim 5, wherein:

the evaluation selector:

includes an evaluation selection register that comprises a respective selection bit for each subset; and outputs a selection signal per selected subset; and evaluation of the actuator characteristic is further based on an address for the selected fluid actuator.

7. The fluidic die of claim 1, wherein:

when the selected fluid actuator is not activated, the actuator evaluator compares an output of a corresponding actuator sensor against a first expected output; and when the selected fluid actuator is activated, the actuator evaluator compares an output of the corresponding actuator sensor against a second expected output.

8. The fluidic die of claim 1, wherein an actuator evaluator compares an output voltage from an actuator sensor against a threshold value to determine a state of a corresponding fluid actuator.

9. The fluidic die of claim 8, wherein the output voltage is compared at the actuator sensor.

10. The fluidic die of claim 1, wherein an actuator evaluator transmits an output voltage from an actuator sensor off die to be compared against a threshold value to determine a state of a corresponding fluid actuator.

11. The fluidic die of claim 1, wherein an output line from the actuator evaluator is to:

transmit an output of the actuator sensor; and transmit an identifier of the actuator under evaluation.

12. The fluidic die of claim 1, wherein each fluid actuator within a primitive has a unique primitive address.

13. A fluidic die comprising:

an array of fluid actuators grouped into primitives;

an array of actuator sensors to receive a signal indicative of a state of a fluid actuator, wherein each actuator sensor is coupled to a respective fluid actuator;

a fluid actuator controller to selectively activate a subset of the array of fluid actuators via an actuation signal;

an evaluation selector to, via a selection signal distinct from the actuation signal, select a fluid actuator to be evaluated independent of an actuation state of the fluid actuators, wherein the evaluation selector comprises an evaluation selection register comprising a respective selection bit for each respective fluid actuator to store evaluation selection data that indicates a set of fluid actuators to be evaluated; and an array of actuator evaluators, each actuator evaluator grouped with a subset of fluid actuators from the array, to evaluate an actuator state of a selected fluid actuator based on:

an output of an actuator sensor paired with the fluid actuator; and a selection signal for the selected fluid actuator.

14. The fluidic die of claim 13, further comprising an array of nozzles, wherein:

each nozzle comprises a fluid actuator of the array of fluid actuators;

each fluid actuator is a fluid ejector which, when activated, ejects a drop of fluid through a nozzle orifice of the nozzle.

15. The fluidic die of claim 13, further comprising an array of microfluidic channels, wherein:

each microfluidic channel comprises a fluid actuator of the array of fluid actuators; and each fluid actuator is a fluid pump which, when activated, displaces fluid within the microfluidic channel.

16. The fluidic die of claim 13, further comprising register logic to:

shift the mask register upon completion of the particular actuation event to indicate another subset of fluid actuators enabled for actuation for another actuation event of the set of actuation events; and shift the evaluation selection register upon completion of a particular evaluation event to indicate another subset of fluid actuators enabled for evaluation for another evaluation event.

17. The fluidic die of claim 13, wherein the subset of the array of fluid actuators to be activated differs from the fluid actuators selected to be evaluated.

18. A method comprising:

populating an evaluation selector with data to indicate which fluid actuators are selected for evaluation;

collect a sense voltage from an actuator sensor grouped with a selected fluid actuator; and evaluating a state of the selected fluid actuator based on the sense voltage.

19. The method of claim 18, wherein, when a selected fluid actuator is not activated, evaluating the state of the selected fluid actuator is delayed until the selected fluid actuator is active.

20. The method of claim 18, wherein evaluating a state of the selected fluid actuator comprises comparing the sense voltage against an expected voltage, which expected voltage is based on whether the selected fluid actuator is active.

* * * * *